US006640666B2

(12) United States Patent
Pliley

(10) Patent No.: US 6,640,666 B2
(45) Date of Patent: Nov. 4, 2003

(54) VISE SYSTEM WITH ARTICLE ENGAGING JAW ACCESSORIES

(76) Inventor: Larry E. Pliley, 469 Newark St., Aurora, CO (US) 80010

( * ) Notice: Subject to any disclaimer, the term of this patent is extended or adjusted under 35 U.S.C. 154(b) by 0 days.

(21) Appl. No.: 10/051,800

(22) Filed: Jan. 18, 2002

(65) Prior Publication Data

US 2003/0136227 A1 Jul. 24, 2003

(51) Int. Cl.[7] ..... G04D 3/00
(52) U.S. Cl. ..... 81/6; 269/283
(58) Field of Search ..... 81/6, 7.5; 269/283, 269/240, 270, 268, 279–285; 968/651, 684, 739; 29/227, 235, 239, 807

(56) References Cited

U.S. PATENT DOCUMENTS

| | | | | | |
|---|---|---|---|---|---|
| 87,868 | A | | 3/1869 | Murray | |
| 1,024,383 | A | | 4/1912 | Weismann | |
| 1,344,700 | A | | 6/1920 | Loomis | |
| 2,178,296 | A | | 10/1939 | Argo | |
| 2,261,055 | A | | 10/1941 | Dulaney | |
| 2,333,114 | A | | 11/1943 | Meyer | |
| 2,366,519 | A | | 1/1945 | Greenberg | |
| 2,464,375 | A | | 3/1949 | Clark | |
| 2,471,103 | A | | 5/1949 | Franks et al. | |
| 2,480,415 | A | * | 8/1949 | Mettler | 269/251 |
| 2,571,176 | A | | 10/1951 | Acrea | |
| 2,672,775 | A | | 3/1954 | Koski | |
| 2,677,292 | A | | 5/1954 | Mongelli | |
| 2,697,462 | A | * | 12/1954 | Connor | 99/579 |
| 3,209,624 | A | | 10/1965 | Shiffman | |
| 3,359,839 | A | | 12/1967 | Miller | |
| 3,403,901 | A | * | 10/1968 | Servadio | 269/243 |
| 3,445,913 | A | | 5/1969 | Piquerez | |
| 3,633,444 | A | * | 1/1972 | Freiburghaus | 29/240 |
| 3,689,056 | A | | 9/1972 | Wiltgen | |
| 3,768,797 | A | * | 10/1973 | Kartasuk et al. | 269/283 |
| 3,774,480 | A | * | 11/1973 | Taylor et al. | 104/112 |
| 3,848,484 | A | | 11/1974 | Fried | |
| 3,930,427 | A | | 1/1976 | Addor | |
| 4,121,485 | A | * | 10/1978 | Braun et al. | 29/239 |
| 4,226,144 | A | | 10/1980 | Pliley | |
| 4,422,629 | A | * | 12/1983 | Carlson | 269/282 |
| 4,564,989 | A | * | 1/1986 | Sogandares | 29/235 |
| 4,848,194 | A | * | 7/1989 | Santorineos et al. | 81/176.1 |
| 5,230,132 | A | * | 7/1993 | Chou | 29/402.08 |
| 5,388,082 | A | | 2/1995 | Chou | |
| 6,152,435 | A | * | 11/2000 | Snell | 269/43 |
| 6,170,813 | B1 | * | 1/2001 | Bowers | 269/282 |
| 6,427,995 | B1 | * | 8/2002 | Steinwall | 269/283 |

OTHER PUBLICATIONS

Catalogue or ad, Sears, *ca 2001* , p. 18, codeKNX019A.
Catalogue, Cas–Ker Update, Sep./Oct. 2000, p. 14 and 12.

* cited by examiner

*Primary Examiner*—George Nguyen
*Assistant Examiner*—Hadi Shakeri
(74) *Attorney, Agent, or Firm*—Edwin H. Crabtree; Ramon L. Pizzaro; Donald W. Margolis

(57) ABSTRACT

A portable vise system is provided to assist in performing various watch repair and maintenance functions and includes a pair of jaws having generally planar and parallel opposing surfaces. The vise can be positioned in a portable nonskid base. The jaws are supported for guided relative movement toward and away from each other along a path disposed substantially normal to the opposing surfaces thereof, one jaw being fixed and the other movable via screw means. The jaws include cylindrical recesses opening outwardly of the opposing surfaces and disposed substantially normal thereto. The opposing jaw surfaces can have relatively thick panel member accessories secured thereto constructed of shape conforming, deformably resilient material and the panel members include substantially circular openings therein substantially coaxial with and of approximately the same diameter as the recesses. A watch case may be clamped between the jaws with eight spaced surface areas of diametrically opposite portions of the watch case engaged by correspondingly spaced portions of marginal portions of the deformable panel members defining the aforementioned circular openings. The relative thickness and physical properties of the panel materials permit gripping even delicate objects firmly without damage.

25 Claims, 11 Drawing Sheets

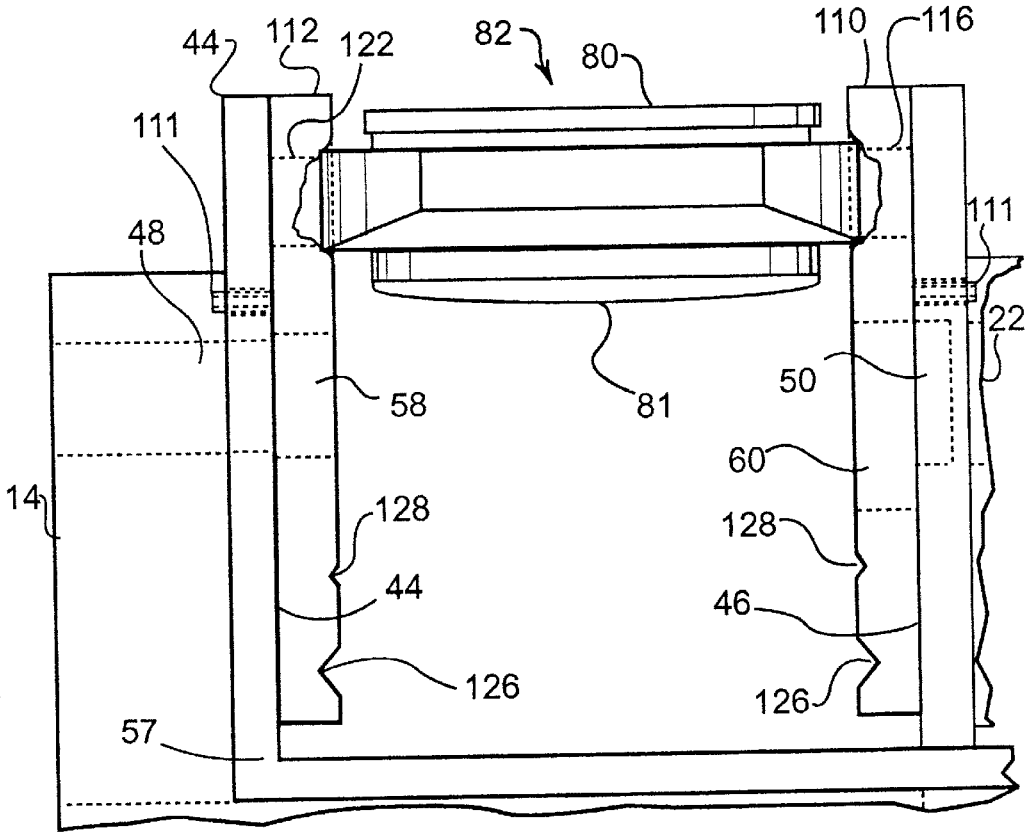
FIGURE 2A
FIGURE 2B
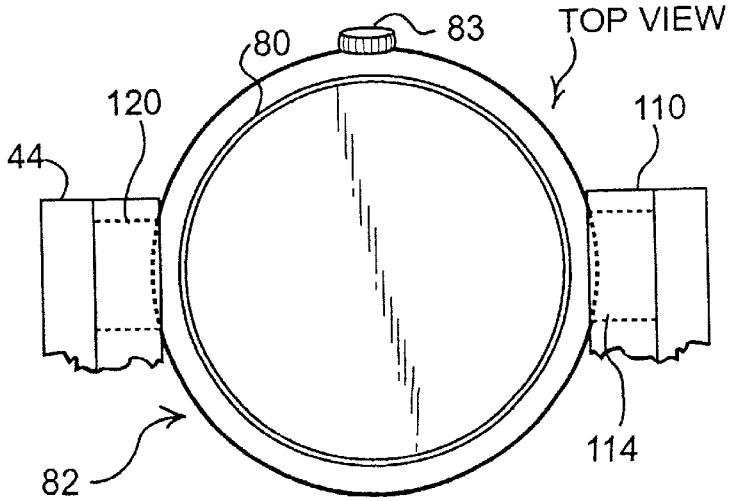

FIGURE 7
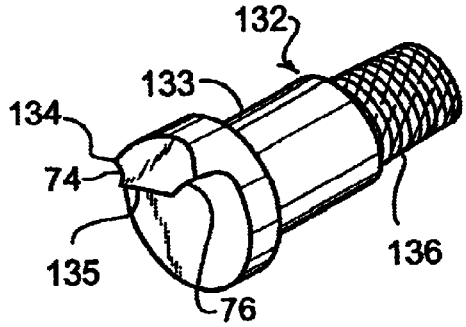
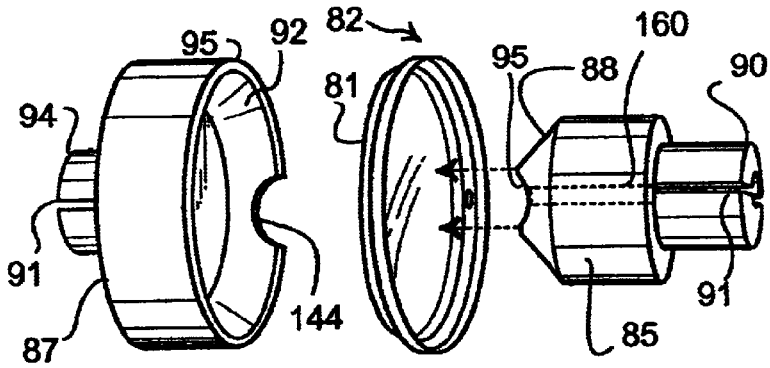
FIGURE 8A
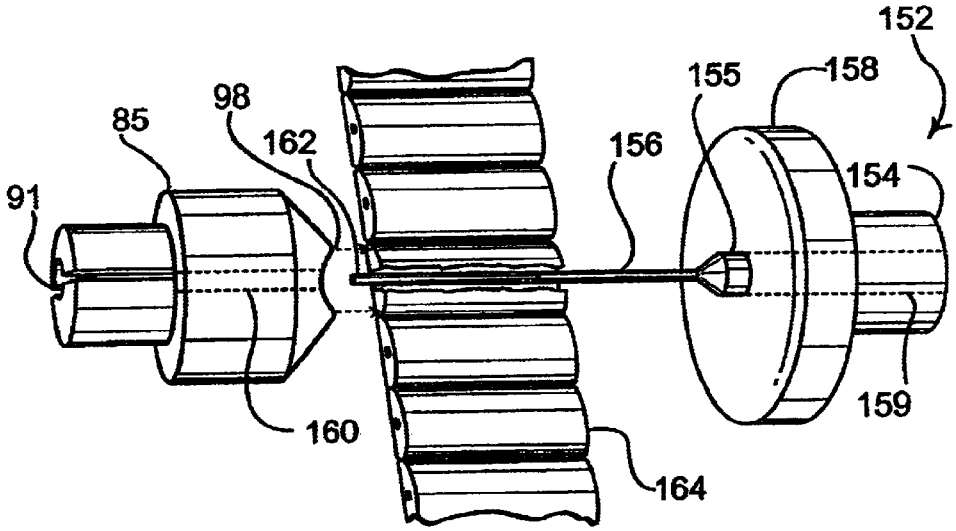
FIGURE 9

VISE SYSTEM WITH ARTICLE ENGAGING JAW ACCESSORIES

FIELD OF THE INVENTION

The present invention relates to the general field of holding tools, and specifically to a vise for engaging watch movements, fine jewelry and the like. This application thus discloses a portable vise system with component engaging jaw accessories used, for example for holding articles during repair and/or work thereon.

BACKGROUND OF THE INVENTION

It is common for vises, tools, vise adapters and the like to be employed for holding watch movements, fine jewelry or small mechanical parts for purposes of maintenance and/or repair. These vises are useful for firmly restraining the article on which work is being performed as well as freeing the hands of the individual performing the work. In order to be particularly useful, such vises must not damage the article being held, yet hold it firmly enough that a significant amount of force may be used when necessary to effect the job.

Various watch repair and maintenance functions are commonly performed on watches and many of these functions require the use of or may be greatly assisted by the use of a multitude of holding devices. For example, various catalogs describe watch holding devices commonly known as case openers, case presses, case wrenches and the like. However, excessive clamping between rigid clamp jaw faces may damage the article. Accordingly, a need exists for a unitary tool of vise construction that may be utilized to firmly support all types of watch cases, other watch components or various articles without imparting damage thereto. Also, a need exists for a vise construction with which various repair and maintenance function supporting adapters may be conveniently used to assist in the maintenance and repair of such small and delicate articles.

This invention relates to a vise with engaging jaw accessories specifically adapted for use with watch movements, fine jewelry, small mechanical parts, ceramic or composite circuit boards and/or other delicate articles that may have irregular shapes without causing damage thereto. With the vise disclosed herein, the user may properly position, easily and firmly hold the article upon which work is to be performed, thereby facilitating complete and efficient access to the article. Additionally, engaging jaw accessories may be easily interchanged for use therewith.

The prior art disclosed several different types of watchmaker's tools and movement holders/vises. U.S. Pat. No. 87,868 to Murray, entitled IMPROVED WATCHMAKER'S TOOL, discloses a tool for straightening the pivots to the wheels of a watch-movement, for trimming off, to finish the ends or heads to the pivots and for finishing the wheels.

U.S. Pat. No. 2,677,292 to Mongelli, entitled WATCH REPAIRMAN'S WORK HOLDER, disclosed a movement holder and support having an adjustable clamp.

A clamping device designed for use with wrist watch movements regardless of size or shape is disclosed in U.S. Pat. No. 2,178,296 to Argo, entitled WRISTWATCH MOVEMENT HOLDER.

Dulaney (U.S. Pat. No. 2,261,055) discloses a portable adjustable vise for supporting a watch movement that has been removed from its case in WATCH MOVEMENT HOLDER.

U.S. Pat. No. 2,333,114 to Meyer, entitled VISE, disclosed a vise having jaws adapted for holding "small articles, such as the movements of time pieces."

A WATCH AND JEWELER'S VISE is described in U.S. Pat. No. 2,366,519 to Greenberg, wherein a vise having slidably mounted jaws and chucks with shaped section for gripping watch parts is disclosed.

U.S. Pat. No. 2,464,375 to Clark, entitled HOLDER FOR WATCH MOVEMENTS, discloses an adjustable holder adapted for standard sized movements.

A WATCH MOVEMENT HOLDER is disclosed in U.S. Pat. No. 2,471,103 to Franks et al., said holder accommodating various sizes and shapes of watch movements. Another WATCH MOVEMENT HOLDER is disclosed in U.S. Pat. No. 2,571,176, said holder positively engaging and locking a watch movement in place with engaging arms that are rotably attached to laterally adjustable supports. Yet another WATCH MOVEMENT HOLDER is disclosed in U.S. Pat. No. 3,848,484, said holder comprising a universal holder adaptable to mechanical, electric or electronic watch movements.

U.S. Pat. No. 2,672,775 to Koski, entitled WATCHMAKER'S VISE, discloses a vise adapted in particular for removing roller tables from balance wheel staffs.

A JIG FOR WORKING ON WATCHBANDS is disclosed in U.S. Pat. No. 689,056 to Wiltgen.

U.S. Pat. No. 3,930,427 to Addor discloses an APPARATUS FOR SCREWING AND UNSCREWING THE BOTTOMS OF WATCH CASINGS.

U.S. Pat. No. 5,388,082 to Chou, entitled WATCHCASE BACK OPENER, discloses an opener incorporating vise apparatus.

Possibly the most relevant prior art relating to the instant invention is U.S. Pat. No. 4,226,144 to Applicant Pliley, specifically incorporated herein by reference in its entirety, in which the precursor to the instant invention is described and claimed.

Shortcomings found in the prior art include, for example, adaptation to a specific size or shape of article, lack of sufficient grip strength, causing damage to the article being held and positional instability of the vise. The present invention overcomes these drawbacks by integral incorporation of portability, adjustability, stability and superior gripping ability without causing damage. The vise of the instant invention overcomes the limitations of the prior art by combining numerous component engaging jaw accessories tools into a single portable vise that is optionally mounted in a stable base portion having a non-slip bottom. The assembly of the instant invention is highly suitable for the above-stated purposes. While prior art devices may be suitable for gripping, e.g., watch cases and movements, the prior art falls short in the areas of causing damage, adapting to infinite sizes and/or shapes of articles to be held, portability, stability and ease and efficiency of use. The present invention provides a portable vise having sufficient gripping strength to hold various article without causing damage thereto, the vise being adapted for use with conventional and unconventional watches, watch cases and movements of various sizes and shapes and adapted to receive accessories useful in the maintenance, repair, adjustment and other procedures typically performed on watches and/or watch movements, in addition to numerous other articles of manufacture.

SUMMARY OF THE INVENTION

Accordingly, it is an object of this invention to provide a vise construction that is effectively designed for supporting and clamping watches and watch movements, regardless of the size and shape thereof, in a manner whereby the clamping engagement is affected with sufficient pressure against the movement without causing damage thereto. An additional object of the present invention is to provide a portable and adjustable vise comprising a vise portion and, optionally, a stable, non-slipping base portion that readily rests on any flat surface and is capable of accommodating various component-engaging jaw accessories.

Another object of this invention is to provide a maintenance and repair function supportive vise for use in conjunction with watches and which conforms to conventional forms of manufacture, that is simple in construction, inexpensive to manufacture, easy to use and extremely efficient in use, operation and service so as to provide a device that is economically feasible, long lasting and relatively trouble-free in operation.

This invention is based on a novel concept for the holding and manipulating of watch movements, fine jewelry, including various gemstones; ceramic or composite circuit boards, small mechanical parts and the like. The vise system of the instant invention comprises two portions: a vise portion and an optional base portion; the former comprising a pair of opposing planar jaw faces relatively movable along a path extending therebetween and normal thereto, and the latter comprising a rigid, stabilizing base into which the vise portion contiguously fits. Various jaw accessories may be employed with the vise portion. For example, the jaw faces of the vise portion may be, e.g., covered with relatively thick panel members secured thereover and constructed of deformable, resilient material which will conform to the shape of a workpiece; the jaw faces having coaxial cylindrical recesses opening outwardly thereof with which openings formed through the panel members are registered and the openings are preferably centrally located in the jaws and substantially the same diameter as the recesses. Various maintenance and repair function supportive accessories are provided including support shanks in the construction thereof, the support shanks of the accessories are snugly receivable through the openings formed in the thick panel members and in the recesses opening outwardly of the opposing jaw surfaces. Further, in the generally upper position of said panels may be disposed one or a plurality of mutually coaxial, substantially circular apertures ranging in size from small, e.g., about 5 mm, to relatively large, e.g., about 20 mm, functioning as vise gripping areas. The apertures can be oval, oblong or other rounded shapes other than circular. More specifically, the smaller apertures in use, expose a larger surface of the held article as a working surface by gripping at closer contact points, while the larger apertures hold larger articles securely and expose most of the article's surface as a work area. The workpiece is held in the vise by being positioned between the apertures of the same size on opposing sides of the vise.

In accordance with the present invention, a portable vise system comprises a vise portion and a base portion, the vise portion including a pair of jaws having generally planar and parallel opposing surfaces and supported for guided relative movement toward and away from each other along a path disposed substantially normal to the surfaces, preferably using screw means, the jaws having coaxial cylindrical recesses formed therein and opening outwardly of said surfaces and disposed substantially normal thereto, with one recess forming a horizontal bore through the jaw and the other forming a blind bore, these recesses being adapted to snugly but removably receive the supporting shank portions of one or two article-engaging jaw accessories thereon. The base portion is adapted to contiguously fit and house the vise portion in at least one working position, and conprises a bottom layer of skid-resistant material. One jaw can be fixed and the other movable by screw means.

Accessories for fitting in the jaws include jaw panel members, wedge tools, male and female adapters, flanged sleeves with arbor pins and adjustable arms with holding means. The panel members include openings therein which are substantially coaxial with and the same general diameter as the recesses in the jaws, one of the openings optionally being substantially rectangular in shape. The panel members further comprise at least one pair of mutually coaxial, substantially circular aperture near the upper surfaces of the panels.

The wedge tool accessory comprises a cylindrical member having a wedge-shaped end extending opposite a knurled shank adapted for functional combination with the recess in the fixed jaw of the vise, defining a sharpened wedge member for wedging between the adjacent portions of a watch back and case.

The female adapter accessory has base and free ends, the base end comprising a diametrically reduced shank poriton snugly but removably receivable through the openings and in the recesses in the vise jaws, the free end defining a shallow outwardly opening recess of generally circular cross-sectional shape, having a chamfered lip and having a larger diameter than a corresponding accessory to be fitted in the opposite jaw of the vise, and optionally having at least one indentation in the chamfered lip thereof, adapted to accomodate projections on a workpiece to be held.

The male adapter accessory also includes base and free ends, the base end including a shank as described above and the free end comprising a rounded terminal end nose. Optionally, the nose can include a rounded recess therein and a hole can extend longitudinally from nose to base end through the entire adapter.

The flanged sleeve with arbor pin comprises a flanged sleeve having an outwardly projecting integral shank portion snugly and removably receivable through and in the cylindrical recess in the moving vise jaw, the sleeve having a longitudinal hole adapted to slidingly accommodate an arbor pin having a base portion and a smaller pin portion.

The adjustable arm with holding means (or multidirectional holding arm) accessory comprises a cylindrical shaft having opposite ends, a rod with opposite ends running therethrough and a locking member, the opposite ends of the cylindrical shaft being removably and snugly receivable through and in at least one pair of cylindrical recesses in the vise jaws, the locking member being mounted on and engaging the cylindrical shaft and the rod to provide rotational and lengthwise rod adjustment. The holding means on one end of the rod can be a clip jaw holder or the like.

The present invention, when practiced as disclosed herein, securely grips watch movements and similar objects at any angle without causing damage thereto. This vise is applicable to all watches, watch movements, watchbands, fine jewelry, small mechanical parts, precious and semi-precious gem stones, and ceramic or composite circuit boards, as well as any other article requiring superior grip strength without causing damage. The instant invention thus is useful to facilitate the maintenance and repair of watches and watch movements, but is not intended to be limited to these uses. As a test, a prototype vise fitted with jaw inserts of high density polyethylene about 0.125 inch inch thick securely gripped a raw hen's egg by its side surfaces (the weakest points) without causing any damage. Thus gripped, the egg was resistant to sliding or rotation. Thus gripped, the egg was resistant to movement by sliding or rotation.

A comparison of certain features and advantages of the "new" vise of the present invention and the "old" or original vise of Applicant's previous patent follows:

Jaw Panels: The old vise employed thin plastic panels intended for flat surface protection of the clamped object, rather than a holding feature; these relatively thin panels would not deform enough around a clamped object or its irregular surfaces to serve as an effective holding tool. The new vise employs relatively thick, deformable panels of high density polyethylene or other suitable materials to allow tight clamping of of objects in the vise without damage, through the panels deforming under pressure to fit the object and/or its surface irregularities exactly. The slight memory and refill abilities of the panels permit them to be reused a substantial number of times. The panels of the old vise did not have openings for holding clamped objects, other than the pass-through openings intended to hold the jaw accessories. The new vise features jaw panels with a plurality of substantially circular openings near the upper surfaces of the jaws and panels, designed to clamp objects of various shapes and sizes securely by gripping on a number of points on each side of the clamped object.

Wedge tool accessories: The wedge tool accessory used in the old vise to open press type watch backs was fixed in position, with no provision for adjustment for watches of different thicknesses or rotation of the accessory to align the wedge portion to fit the watch case being serviced. The new vise employs an improved wedge tool and jaw configuration which allows for vertical adjustment of the watch in the jaws to align with the wedge tool, via a vertical rectangular opening in one jaw. The wedge tool is adapted to extend through a hole in the vise jaw so that a knurled end can be manipulated to rotate the tool and adjust the wedge portion to align between the watch case and its back. In addition, this extended portion of the wedge tool can be gently tapped to aid in removal of a watch back once the tool is properly positioned and aligned with respect to the watch case.

Accessory cups or female adapters: Since the old vise was intended for use with digital watches without protruding stems or crowns, the female adapters disclosed had no provision to accomodate such projecting components. The female adapters of the present invention include at least one cutout portion on the lip edge to accomodate the crown or other projections when pressure is exerted on the watch case, thus protecting the stem, crown or the like from damage. Pressure on a watch crown can break the stem, rendering various setting features of the watch useless.

Watchband disassembly: The old vise did not include any accessory for pressing out pins from watchbands or similar services. The vise of the present invention includes a flanged sleeve accessory which accepts an arbor pin having a slim tip adapted to enter watch band links to remove the pins, thus allowing the removal of links to resize the watchband. The process is descibed below.

Skid resistant base: The old vise lacked a base component, so had to be fastened by a vise or clamp on a bench or other work surface in a fixed work site. The vise of the present invention is portable, featuring a skid resistant base which accomodates the vise in at least one recess formed therein, thus allowing the vise to be positioned in at least one suitable working position at almost any work site.

All embodiments of the instant invention include the same general methodologies, objects and elements; an improved vise system with component-engaging jaws and accessories; and may further comprise customizing features and specifications. Other features, objects and advantages of the present invention will become apparent from the following detailed description, taken in conjunction with the accompanying figures and appended claims, which illustrate by way of example, the principles of the instant invention. Like numerals are used to identify like parts in the various figures. For clarity and better illustration of the features of the invention, certain components may be omitted in some views, and certain components may be shown in exaggerated scales.

BRIEF DESCRIPTION OF THE DRAWINGS

FIG. 2*a* is a partial side view of the jaw portion of the vise of FIG. 2, holding a watch case horizontally;

FIG. 2*b* is a partial side view of the vise of FIG. 2, holding a watch case vertically;

FIG. 7 is a perspective view of a wedge tool jaw accessory;

FIG. 9 is a perspective view of a flanged sleeve and pin jaw accessory;

DETAILED DESCRIPTION OF THEE INVENTION

Figure 1:
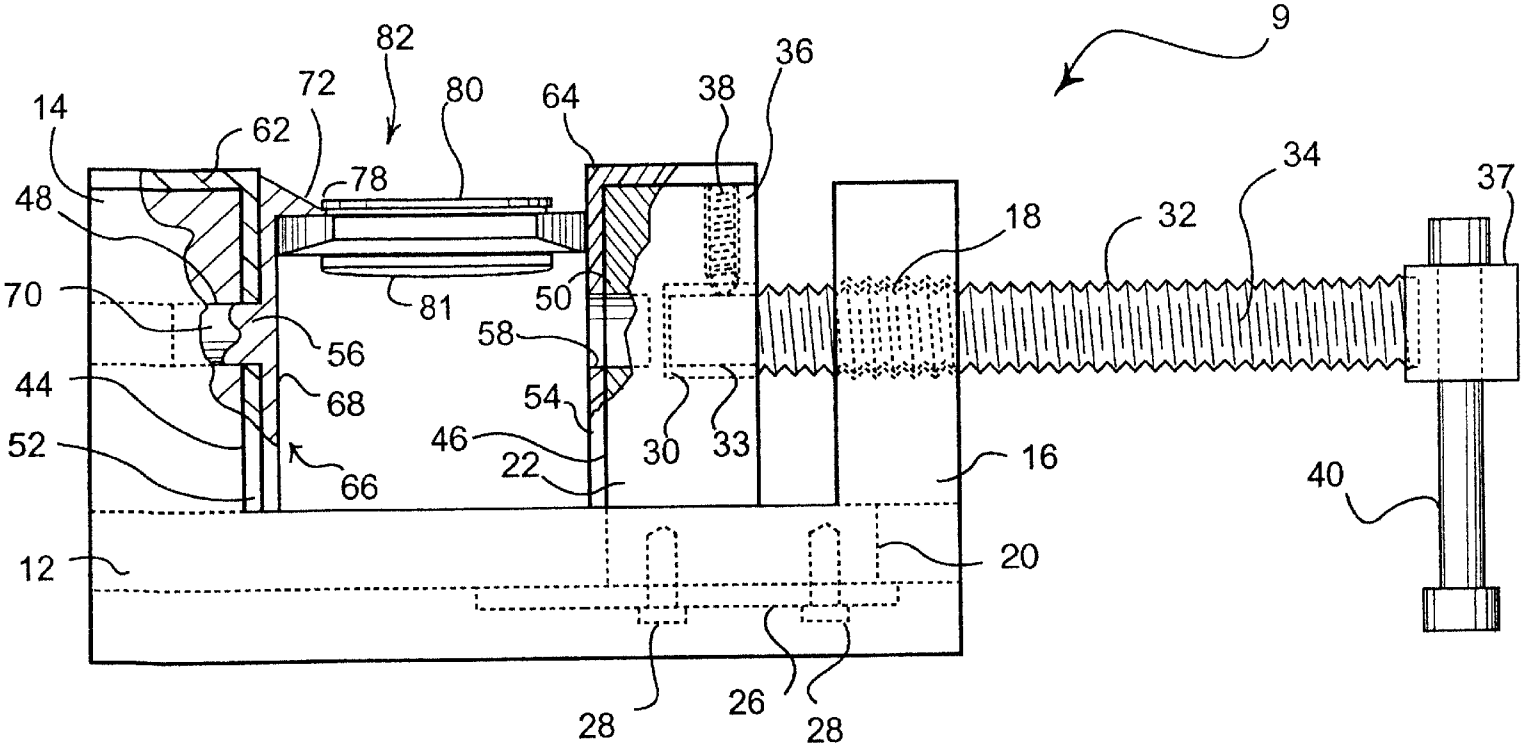
FIGURE 1 (PRIOR ART)
FIG. 1 is a side elevational view of a prior art vise constructed in accordance with the invention disclosed and claimed in the U.S. Pat. No. 4,226,144 and with a watch back removing attachment supported from one jaw of the vise, portions of the vise and back removing attachment being broken away and illustrated in vertical section, hereby incorporated by reference.

It is to be understood that both the foregoing general description and the following detailed description are exemplary and explanatory only and are not restrictive of the invention as claimed. The term "and/or" is used in the conventional sense, in which "A and/or B" signifies either A or B or both. Tile devices of the invention will be described in a terrestrial frame of reference, with the bottom being the surface which normally is adjacent to the top of a workbench or other bearing surface, the top being the opposite surface.

The present invention provides a vise system comprising a vise portion and an optional base portion, said vise portion having component-engaging jaw accessories useful for holding watches, watch movements and the like. It will be recognized by those skilled in the art that a broad range of vise assemblies may be produced in accordance with the presently disclosed invention. Moreover, the vise portion may be separated from and effectively used without the base portion, further enhancing its portability. For example, the vise can be held in conventional vises, clamps or work benches. The details of the basic structure of a preferred embodiment of the invention include two major portions: a base portion and the engaging vise portion. The base portion is a rigid base constructed of any suitable solid material, e.g., ABS plastic, formed by any conventionally known procedure and adapted such that the bottom of the vise portion fits contiguously and securely inside a recess in the base portion. Alternatively or additionally, another surface of the vise portion can be adapted to fit into a base recess, thus orienting the vise and its jaws differently. The base portion preferably further comprises a layer of skid-resistant material on the bottom surface of the base, facilitating portability as well as stability such that the vise is not easily slid across a flat surface, thereby preventing disturbance of the work-in-progress. Skid-resistant material may include any suitable natural or synthetic polymeric material having the desired modulus and frictional properties. For example, a commercial polymeric material called "Voltextra" and obtained from the Voltek Co. (Coldwater, Mich.), was found to provide a skid-resistant layer whereby with a minimum of downward pressure, skid-resistance and stability were achieved without the use of suction cups, levers, fastening vises or the like. This particular material was a coated polyethylene laminated or backed with a compact polymeric foam material from the Merriweather Company of 1212 Wynette Rd., Sylacauga, Ala. 33151. Where it is desirable to position the base and vise more securely, the base (or the vise alone) can be attached to a workbench or other work surface by any suitable mechanical fasteners such as bolts, screws, nails, clips, brackets or the like. Combinations of hook-and-loop material fasteners, or even magnetic materials, can also be used. The vise, with or without the base, can also be held in another type of vise or positioned with various holding devices on certain work benches.

The engaging vise portion includes a pair of opposing planar jaw faces relatively movable along a path extending therebetween and normal thereto. Article-engaging jaw accessories are employed therewith, e.g., the jaw faces may be covered with panel member jaw accessories, constructed of deformable, shape-conforming, resilient material and having various corresponding apertures passing therethrough for adjustment purposes. The jaw faces have coaxial cylindrical recesses opening outwardly thereof with which centrally positioned circular or rectangular openings formed, for example, through the panel members, are registered and the openings are substantially the same diameter as the recesses. Various other maintenance and repair function supportive accessories are provided, each including support shanks which are snugly receivable through the openings formed in the panel members and/or in the recesses opening outwardly of the opposing jaw surfaces.

The bulk of the vise is formed of a material that facilitates the necessary vise engagement and grip strength and rigid structure of the instant invention for example, suitable metals, preferably metal alloys, and more preferably, zinc and/or aluminum alloys. Non-ferrous metals can be used when magnetic materials are to be excluded, and non-sparking metal alloys such as bronze can be used where sparks would be a hazard.

Figure 4:
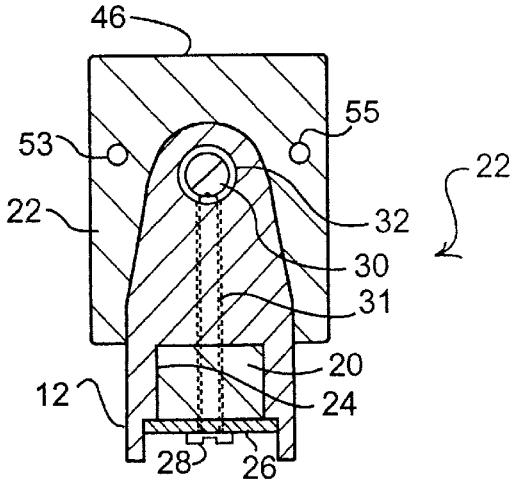
FIG. 4 is a vertical sectional view taken substantially upon the plane indicated by the section line 4—4 of FIG. 2.

Referring more specifically to the drawings, in FIG. 1 the numeral 9 generally designates a vise constructed in accordance with the prior art invention of Applicant's U.S. Pat. No. 4,226,144. Other views are shown in the patent drawings. The vise 9 comprises a commercially available vise including an elongated slotted base 12 from one end of which an upwardly projecting stationary jaw 14 extends. The other end of the base 12 supports an upstanding abutment 16 having a threaded bore 18 formed therethrough and the transversely narrowed lower end portion 20 (shown here and in FIG. 4) of an upstanding movable jaw 22 is slidably received in the central longitudinal slot 24 (see FIG. 4) of the base 12 for guided movement along the latter. A plate 26 is secured to the underside of the portion 20 by mechanical fasteners 28 in order to secure the portion 20 in position slidably and guidably received within the slot 24, as seen in FIG. 4.

The movable jaw 22 includes a blind bore 30 formed in the side thereof opposing the abutment 16. Bore 30 is coaxial with the bore 18 and has a smooth portion 33 of a jaw adjustment screw 34 removably and captively rotatably received therein. The movable jaw 22 also includes a vertical threaded bore 36 opening into the bore 30 and in which a set screw 38 is threadably engaged for retaining the adjustment screw 34 within the bore 30. The screw 34 is threadably (32) received through the bore 18 and includes a slide type diametric handle lever 40 supported from its end 37 remote from the jaw 22. This is merely exemplary of threaded means for moving jaw 22. Tile above may be considered as descriptive of a conventional form of a vise, which type of vise may be used by persons performing maintenance and repair functions on watches or the like.

The jaws 14 and 22 include opposing planar faces 44 and 46 disposed substantially normal to the path of movement of the jaw 22 toward and away from the jaw 14 and the jaws 14 and 22 include cylindrical recesses 48 and 50 formed therein opening outwardly of the faces 44 and 46. The recesses 48 and 50 are coaxial and the recess 48 forms a horizontal bore formed completely through the jaw stationary 14 while the recess 50 comprises a blind bore substantially coaxial with the bore 30.

In addition to the jaws 14 and 22 including the recesses 48 and 50, the faces 44 and 46 thereof are covered by planar thin panel members 52 and 54 secured thereover in any convenient manner such as by adhesive and these panel members are described as constructed of shape retentive, stiff but slightly deformable resilient material. A typical material of which the panel members 52 and 54 may be constructed comprises a high density polyethylene. The panel members 52 and 54 have circular openings 56 and 58 formed therein coaxial with the recesses 48 and 50 and of substantially the same diameter. Accordingly, a thin circular watch case 82 as shown may have diametrically opposite portions thereof seatingly received within the openings 56 and 58 (not shown here) and the jaw 22 may be adjusted toward the jaw 14 whereby to securely clamp the watch case between the jaws, each panel member 52 and 54 engaging the corresponding side of the thin watch case at four spaced points via holes 56 and 58 and the stiff but deformably resilient material of which the panel members 52 and 54 are constructed reportedly enabling even gold watch cases to be firmly supported between the jaws 14 and 22 without damage to the watch case. However, such positioning of a watch case or other object a substantial distance below the upper surfaces of the vise jaws may be inconvenient, offering limited access to the workpiece. Furthermore, it has been found that holes 56 and 58 in the thin panels 52 and 54 would easily deform into metal jaws 14 and 22 when pressure is applied. Also, it was difficult to install and replace the panels.

Figure 3:
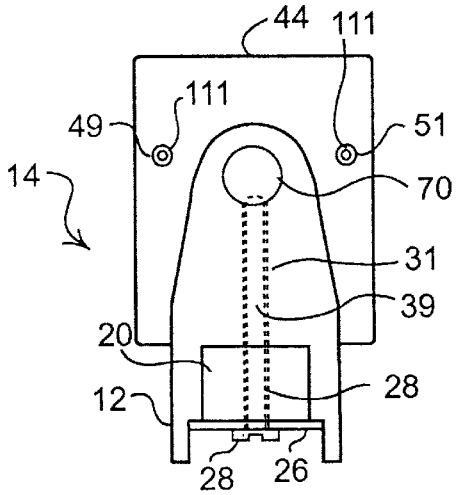
FIG. 3 is an end elevational view of the assemblage of FIG. 2 as seen from the left side thereof.

The panel members 52 and 54 include vertical marginal portions which correspond to and overlie corresponding marginal portions of the jaws 14 and 22 (Not shown here; see FIGS. 3 & 4). The upper marginal portions of the panel members 52 and 54 include oppositely directed right angle integral flange portions 62 and 64 which overlie and are adhered to the upper surfaces of the jaws 14 and 22 by any suitable means.

Also shown in FIG. 1 is a first form of attachment which may be used in conjunction with the prior art vise 9. The attachment is referred to in general by the reference numeral 66 and comprises a planar panel 68 constructed of high carbon steel and which conforms in shape to and may overlie the panel member 52 in the manner illustrated in FIG. 1. The central portion of the panel member 68 includes an integral cylindrical shank 70 projecting from its rear side, which shank 70 is snugly receivable through the opening 56 and in the bore 48. Also, the upper marginal portion of the panel member 68 includes a sharpened horizontal wedge-shaped lip 72 extending therealong and projecting from the forward side of the panel 68. The wedge-shaped lip 72 includes oppositely beveled end portions 74 and 76 (as shown in FIGS. 4 and 5 of the patent), but the central portion of the lip 72 defines a sharp wedge edge 78 which may be used in the manner illustrated in FIG. 1 herein (and FIG. 4 of the patent) to initially "break" the back 80 from a watch case 82 disposed between the jaws 14 and 22, the watch case 82 actually being clamped between the panel member 54 and the lip 72 of the attachment 66. As seen in FIG. 1, one side of watch case 82 is held directly by the surface of panel member 54, without benefit of recesses or indentations. This may allow the workpiece to shift or slip against the panel while work is in progress, requiring substantial skill of the workman. Also, the lip 72 may be used to remove crystal retainer rings in substantially the same manner and the use of the lip 72 in removing a back or crystal retainer ring avoids damage to watch cases due to handheld wedge tools "slipping".

Figure 2:
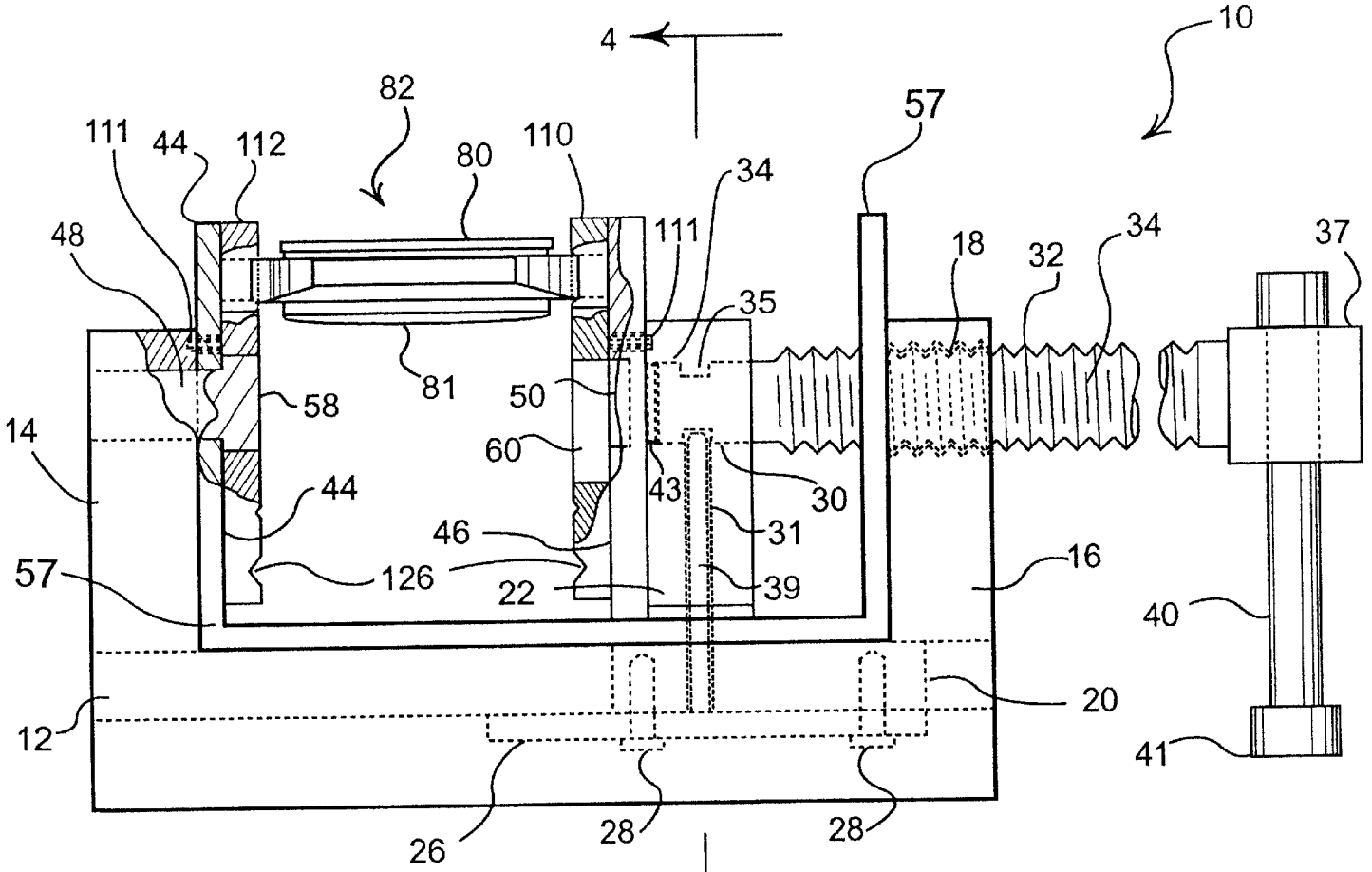
FIG. 2 is a side elevation view of a vise constructed in accordance with the present invention, portions of the vise being broken away and illustrated in vertical section.
Figure 2C:
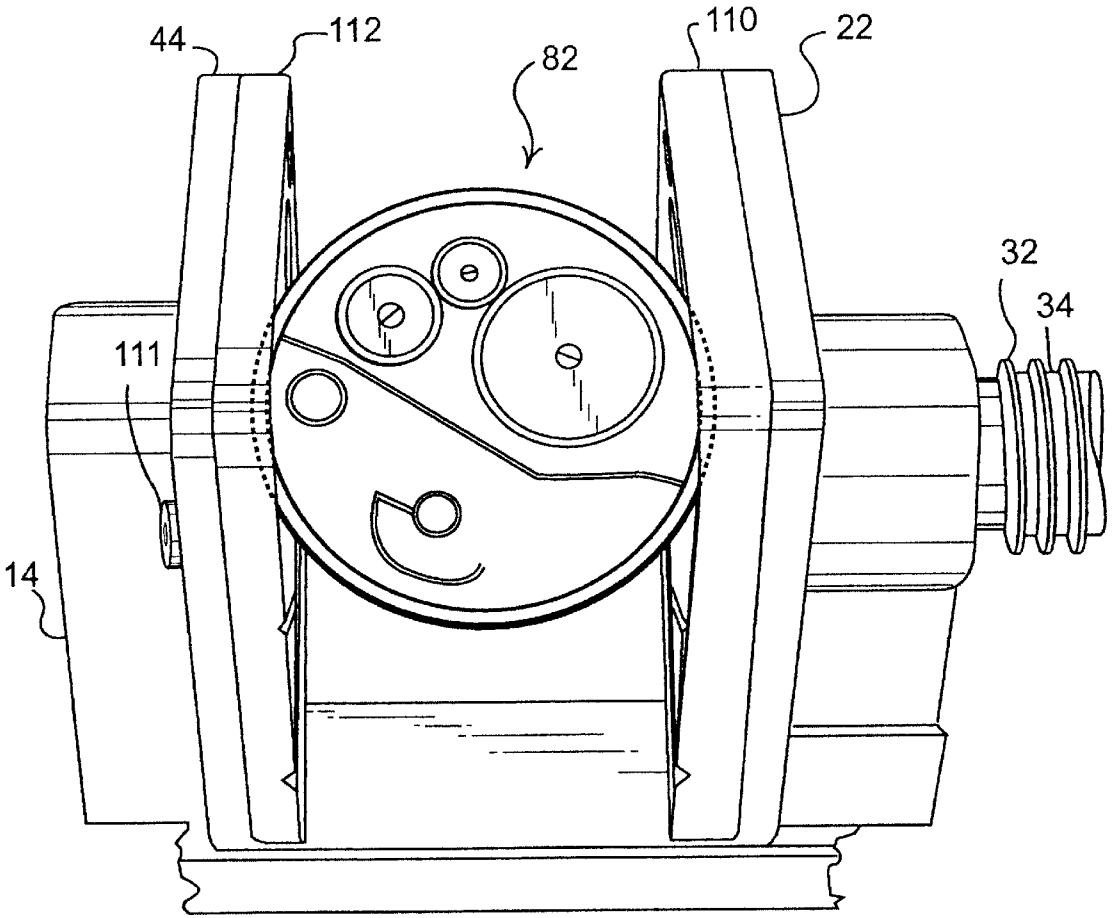
FIG. 2*c* is a partial side view of the vise of FIG. 2, holding a watch movement in an oblique position.

As shown in FIGS. 2, 3 and 4 , the portable vise 10 of the instant invention also includes a movable jaw 22, the jaw having a round receiving pin hole 31 entering from the bottom of the jaw and extending into the receiving main screw bore 30. With the movable jaw 22 installed on the vise body 12, a correspondingly sized pin 39 (with clearance) is inserted into the receiving bore 30 resting in the groove 35 of the main screw 34. A slide plate 26 attaches to the bottom section 20 of the movable jaw 22 with fasteners 28, keeping the pin 39 in place to move the jaw 22 with the action of the main screw 34 via threads 32. A smooth washer 43 can be placed between the end of screw 34 and the metal jaw surface inside bore 30 of movable jaw 22 to minimize friction. Washer 43 can be made of solid nylon, tetrafluoroethylene or similar "slippery" polymers. Cap 41 can be removably attached to lever 40 by threads or other suitable means.

More specifically, the jaws 14 and 22 include opposing planar faces or panels 44 and 46 disposed substantially normal to the path of movement of the movable jaw 22 toward and away from the jaw 14. Face 44 of stationary jaw 14 can be a part of a continuous liner or flange 57 for the inner surfaces of the vise, including stationary jaw 14 and upright 16, as shown. This component provides strength and support for the jaws. The jaws 14 and 22 include several (at least two) cylindrical recesses, 48 and 50 respectively, formed therein opening outwardly of the faces 44 and 46. The recesses 48 and 50 are coaxial with each other and the recess 48 comprises a horizontal bore formed completely through the jaw 14 while the recess 50 comprises a blind bore substantially coaxial with the bore 30. Both recesses are adapted to receive the shanks of various accessories for pressing watch backs, crystals, etc. Screw 34 can press directly against jaw face 46 (via washer 43) when holding a watch case or the like. Recess 48 is designed to accomodate a wedge tool, discussed below.

Now turning to FIGS. 2, 3, 4, 5*a*, 5*b* and 5*c*, in addition to the jaws 14 and 22 including the recesses 48 and 50 respectively, the faces 44 and 46 thereof may be covered by removable, planar panel member jaw accessories, 112 and 110 respectively, removably secured thereover in any convenient manner, and preferably adapted to have at least one shank 111 received in and removed from the recesses 49, 51 and 53, 55 in jaw faces 44 and 46, respectively.

The panel members 110 and 112 include at least one, preferably more than one, and more preferably two integral shanks 111 (preferably cylindrical) projecting from their rear sides, and the shanks 111 are snugly receivable through the opening recesses in the jaw panels 44 and 46, e.g., 49, 51 or 53, 55. The shanks 111 can be hollow to facilitate the press fit, and can be secured on the outward sides of the jaws where they protrude , if necessary. Panel members 110 and 112 are preferably formed with integral shanks 111 by injection molding or other suitable processes. Such panels, with shanks 111 forming press fits into the holes in the jaw faces, are a considerable improvement over the panels used in the vise of Applicant's previous patent, since they keep the panels in place while pressure is applied yet can be easily and economically replaced. The previous panels, if applied with double-sided tape backing, tended to slip under pressure. On the other hand, if more permanent adhesives were used to install the panels, they were difficult to remove and replace.

Figure 5A:
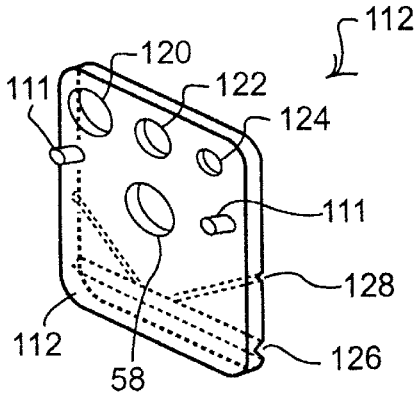
FIGS. 5*a* and 5*b* are perspective views of corresponding panel jaw accessories.
Figure 5B:
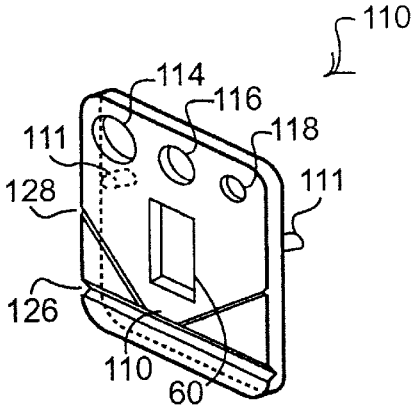

The panel members 110 and 112, shown in FIGS. 5*a* and 5*b*, are constructed of shape conforming, deformable, resilient material, which can be any natural or synthetic polymeric material having suitable modulus and other properties, preferably high density polyethylene. Other types of polymers which may be used include linear low density polyethylene, certain polyurethanes and various types of rubbers. The panel members should comprise polymeric material having physical properties and sufficient depth to readily deform and conform to the finest surface irregularities of a workpiece, prerably substantially exactly, when placed between the jaws under pressure, including, e.g. common coins or even the surface roughness of an egg. This permits the most delicate and/or irregular of objects to be retained securely in the vise jaws without danger of slipping or rotating in position. While not wishing to be bound by theory, it is believed that the surface tension or friction of the jaw panel materials conforming to the surface features of the workpiece prevents slipping or rotation without requiring excessive jaw pressure to retain the workpiece. Materials and thicknesses for the panel materials can be selected to suit specific workpieces such as watches, jewelry including gemstones, coins, balsa wood model parts and the like, or can be designed to suit the majority of workpieces expected.

The panel members should be relatively thick with regard to the workpieces and their surface irregularities to properly deform and conform to workpieces. This will vary according to the size of the vise and workpieces, but for items such as watch cases, the panels can range from about 0.1 to about 0.3 inch, preferably from about 0.12 to 0.25 inch, and most preferably from about 0.125 to about 0.225 inch in thickness. Panel members having different properties and/or thicknesses can be installed to suit particular tasks and workpieces. After substantial repeated use, the panel material may develop relatively permanent indentations and require economical replacement of the molded panes for best results. In use, the panel material can deform to form new indentations to fit the objects clamped, even atop indentations from previous use. After considerable use, the panels may compress to a depth which is less useful, or even break between the holes or apertures therein, possibly permitting the workpiece to be pushed into the metal jaw face.

The panel members 110 and 112 have a plurality of mutually coaxial substantially circular openings, e.g. the three corresponding openings 114, 116, 118 and 120, 122, 124 of various useful diameters formed therein, preferably near the upper edges of the panel members. These openings are coaxial with those on the opposite panel of the same size when the panels are installed in the vise jaws. For example, for handling watches, the diameters of the smallest to the largest coaxial circular openings may range from about 5 mm to about 20 mm, and preferably comprising about 5, 8 and 15 millimeters in corresponding opposed openings, i.e., 118/124, 116/122, 114/120, respectively. Accordingly, a watch case 82 or movement with a crown 86 (as shown in FIG. 2 plus detail views FIGS. 2*a* and 2*b*) may have diametrically opposite portions thereof seatingly received within a pair of the circular openings 114, 116, 118 and 120, 122, 124 and the movable jaw 22 may be adjusted toward the stationary jaw 14, thereby securely clamping the article between the jaws, each panel member 110 and 112 engaging the corresponding sides of the article at eight points, i.e. two diametrically opposed surfaces having two upper points of contact and two lower points of contact on either side of the article. The deformably resilient material of which the panel members 110 and 112 are constructed enables even relatively soft watch cases, e.g., gold, to be firmly supported between the jaws 14 and 22 without damage to the watch case, while providing superior gripping strength. As shown in FIGS. 2*a* and 2*b*, such an object can be held in horizontal, vertical or other positions.

At present, the most preferable panel material for holding watches, watch parts and jewelry is certain types of high density polyethylene. This material (of suitable modulus) deforms with light pressure to fit round, oblong or odd-shaped objects across diametric surfaces exactly in the center of the circular openings. The recess created by the pressure has a "material memory" which may suit a like-shaped object in later uses. If an unlike object is clamped in the same area and a new recess is formed to fit, the material moves under minimal pressure to form an exact grip on the new object. Such clamping actions may deform either used or unused material into an old valley without loosening material. Its memory comes from material movement without loss of material, but rather with an additional compression, and it gains "new memory". The edges of the circular openings eventually wear from repeated compressions, the edges becoming effectively chamfered to allow a greater holding surface area. However, after many repetitions (perhaps hundreds) of these compressions, the inside edges of the openings may compress enough to allow the workpiece to touch the metal jaw faces, so the panel member(s) must be replaced.

Panel members 110 and 112 can include slots or grooves 126 cut substantially parallel to and near the lower inner edges of the panels, in corresponding positions. The jaws can then be closed to retain small rodlike structures between these grooves. The panel material and the sizes and shapes of these grooves can be adapted to permit the gripping of such rodlike structures in a firm or rotatable manner. With the rod seated in the grooves with minimal pressure, the grooves act as a sort of bearing surface for the rod when rotation is attempted. This mode of operation is useful for such tasks as slotting, engraving or drilling fine tubing without causing surface grip damage from the jaw material. The panels can be rotated 180 degrees to emplace these grooves near the tops of the jaws if desired. Additional grooves 128 can be cut into the same surfaces of the panel members at oblique angles (e.g., 30, 45 or 60 degrees) with a drill press or the like to allow for other delicate tasks such as miter cutting of delicate tubing and the like at set angles.

Figure 5C:
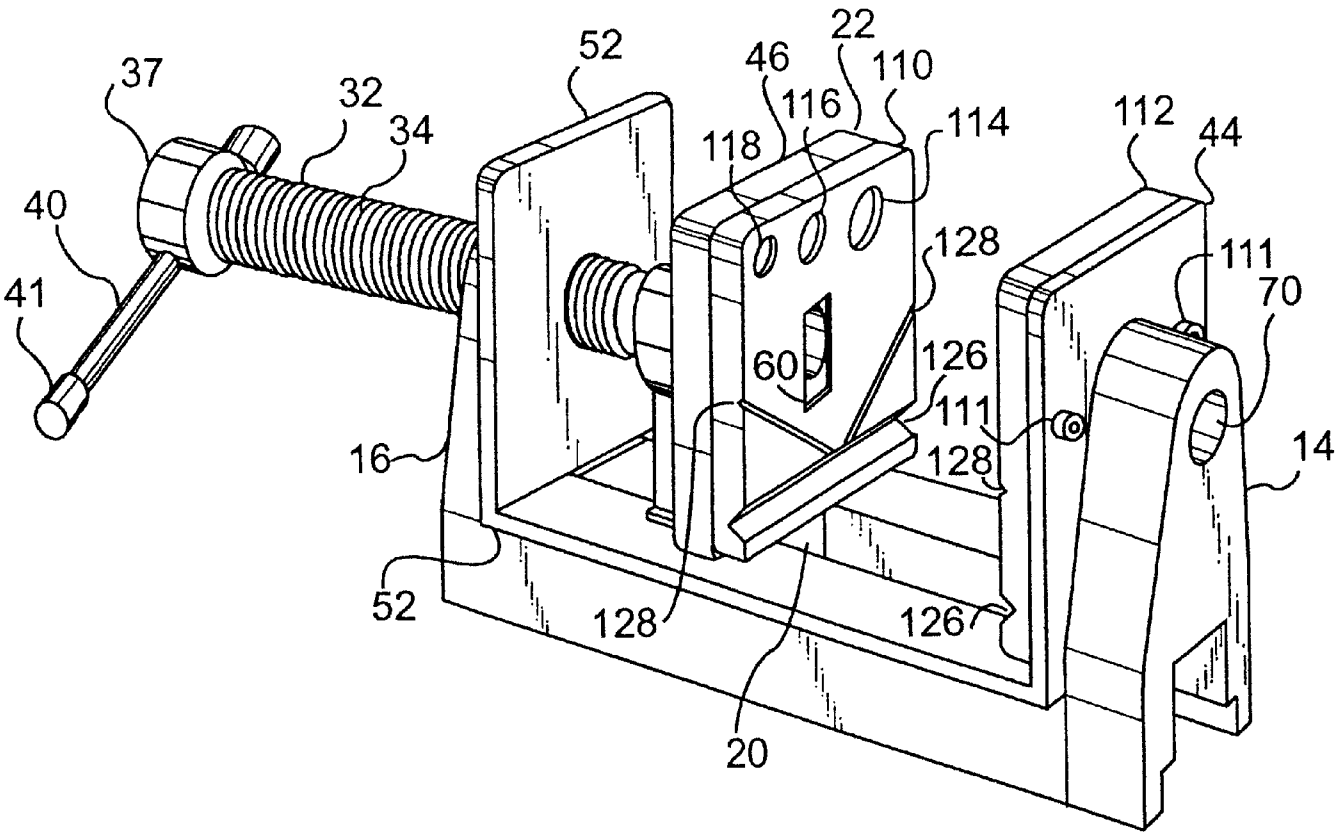
FIG. 5*c* is a perspective view of a vise of the invention fitted with the panel jaw accessories of FIGS. 5*a* and 5*b;*

FIG. 5*c* provides a perspective view of the vise with panel members 110 and 112 installed, illustrating the relative positioning of the features described above. FIG. 5*a* illustrates a round hole 58 through panel 112 which corresponds to hole 48 in stationary jaw face 44 when installed, allowing shanks for various accessories to be inserted. FIGS. 5*b* and 5*c* illustrate a rectangular hole 60 in panel member 110 which corresponds substantially to recess 50 in jaw face 46 when installed. This rectangular vertical opening allows the vertical positions of watches of various case thicknesses to be adjusted so that their cases are positioned correctly with respect to accessories or tools such as the wedge tool described below.

Figure 6:
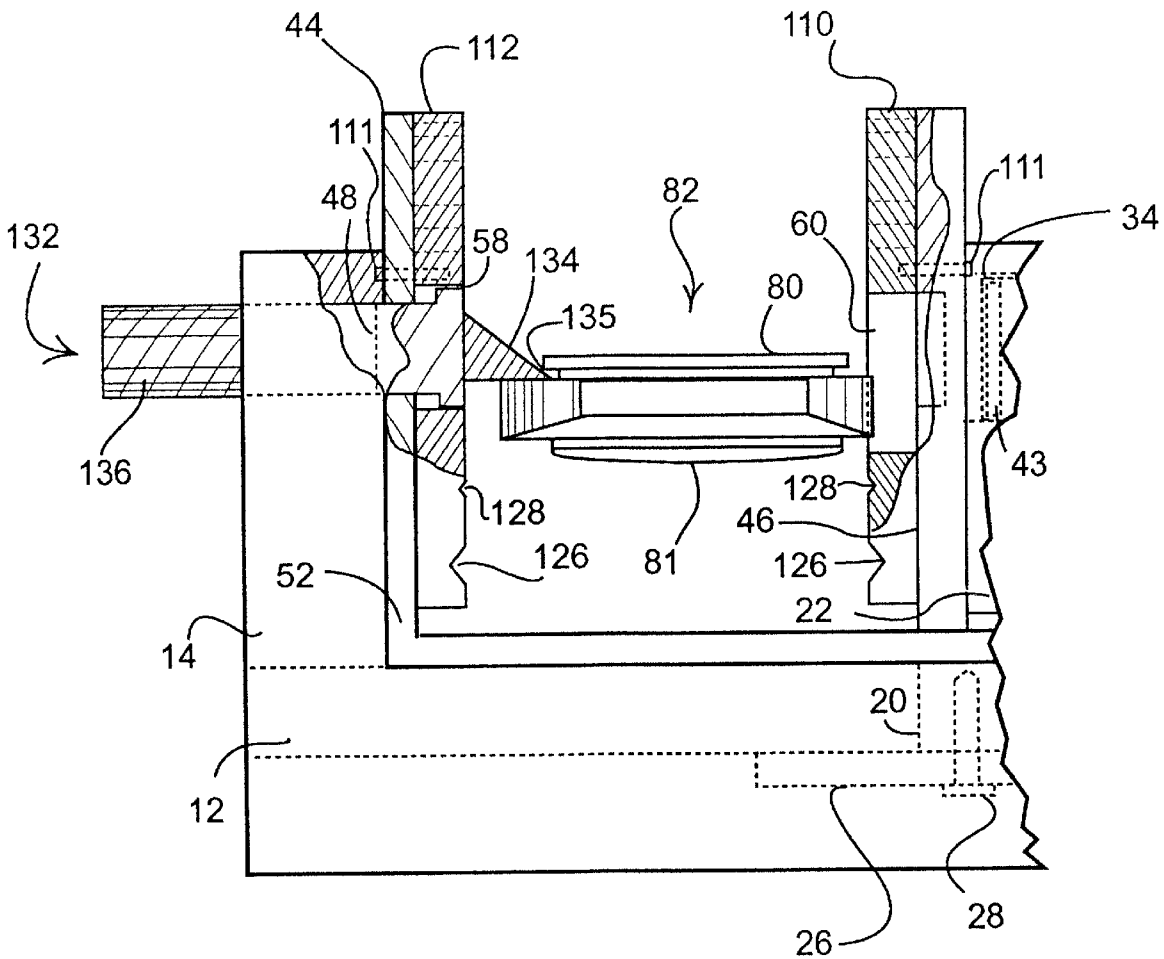
FIG. 6 is a side elevation view of a vise constructed in accordance with the present invention and with a wedge tool jaw accessory supported from one jaw of the vise, portions of the vise and back removing attachment being broken away and illustrated in vertical section.

Referring to FIGS. 6 and 7, there may be seen another form of jaw accessory, an improved wedge tool 132, that may be used in conjunction with the vise 10 of the present invention. The jaw accessory 132 comprises a cylindrical member 133 having a wedge-shaped end 134 extending opposite a knurled or otherwise roughened shank 136, which is constructed of suitable metals or alloys such as, for example, high carbon steel, and which is adapted for functional combination with the recess 48 in stationary jaw 14 in the manner illustrated in FIG. 6. The wedge-shaped accessory 132 may include oppositely beveled end portions 74 and 76, but is principally defined by a sharp wedge edge 135 that may be used in the manner illustrated in FIG. 6; that is, to remove the back 80 from a watch case 82 disposed between jaws 14 and 22, the watch case 82 actually being clamped between the panel members 110 and 112 and the jaw accessory 132. Wedge-shaped end 134 can be formed in suitable lengths to fit various watch cases as shown in FIG. 6. Jaw accessory 132 enables vertical adjustment of the article in relation to the wedge lip 135 of the attachment via a vertically positioned rectangular orifice 60 in the opposing jaw 22, where the opposite side of watch case 82 is lodged. Also, the jaw accessory 132 facilitates manual rotational adjustment and alignment of the wedge. If desired, the wedge and workpiece can be oriented vertically, for better visibility. When the wedge lip 135 is properly seated between the two portions of a watch case, i.e., the back 80 and the case 82, inward vise jaw movement opens the watch case by separating the back from the case portion. Alternatively, because the wedge tool knurled shank 136 protrudes through bore 48 in jaw 14, a mallet tap to the protruding knurled shank 136 of the wedge accessory effectively "pops" or gently lifts the back of the watch case, depending upon fit, without causing damage thereto.

Figure 8:
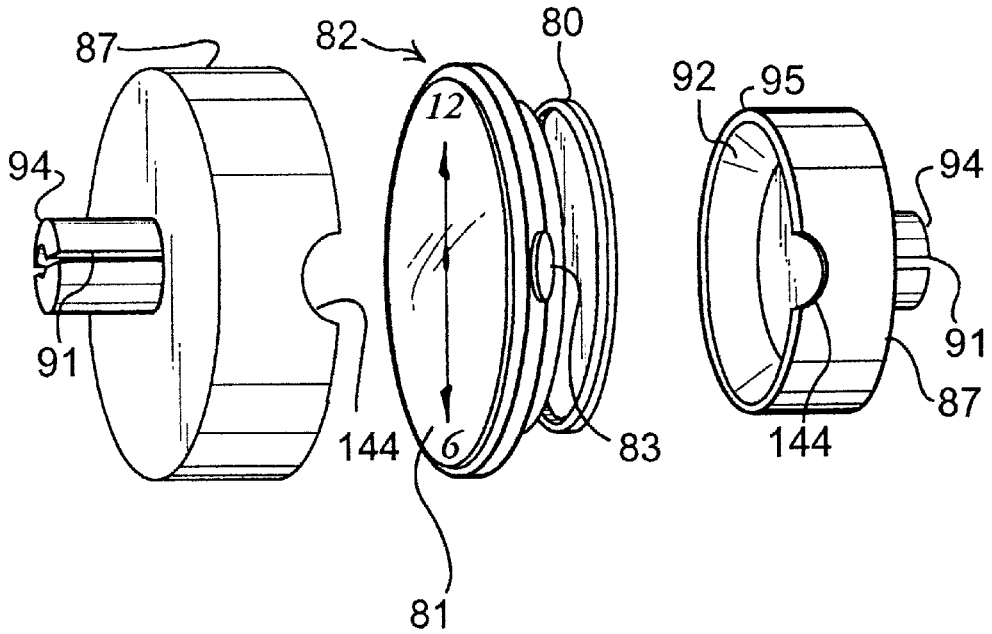
FIG. 8 is a perspective view of the male portion of an adapter jaw accessory situated adjacent the female portion of an adapter jaw accessory.

Referring now to FIG. 8, another attachment, a pair of female adapters 87 that are removably supportable from the jaws 14 and 22, are shown. The female adapter 87 comprises an elongated female member defining endwise (outwardly opening) a substantially circular recess 92 further having inward sloping chamfer lip edging 95 including at least one or a plurality of various sized and/or spaced indentations 144 adapted to receive protruding components of the workpiece such as, e.g. watch crowns (83), timer switches and the like, on the lip thereof on one end and a diametrically reduced shank 94 with compression slot 91 (to provide a snug fit in the recesses in the jaws) on the other end. The shanks 94 of the two female adapters are snugly receivable within recess 48 in stationary jaw 14 (on left, not shown) and recess 58 in panel member 112, and in the recess 50 in the movable jaw 22 (on right, not shown) of vise 10 and through the rectangular opening 60 formed in the panel member 110. With two female adapters 87 positioned in this way, with the larger one over crystal 81 and the smaller one over the press back 80 of watch case 82, the vise jaws can be tightened to press the back on after service. The female and male adapters can be formed by suitable molding processes of suitable polymeric materials, rigid or resilient, so as not to damage workpiece surfaces such as precious metal, solid or plated.

FIG. 8*a* illustrates the use of a female adapter 87 with a male adapter 85. The male or "bullet" adapter 85 comprises an elongated male member defining a rounded nose 88 at one end and a cylindrical shank 90 at its other end by which the adapter 85 may be supported from the moving jaw 22 (on right, not shown). The shank 90 is receivable in the bore 50 and hole 60 in panel 110 in the same manner as the various shanks disclosed herein are receivable in the bore 48. A central hole 160 is provided, and slot(s) 91 facilitate a snug fit in the jaw recesses.

In one use of male adapter 85, a flexible crystal 81 may be centered relative to and clamped between the adapters 85 and 87 in order to decrease the radius of curvature thereof and, therefore, the overall diameter of the crystal. In such condition, the crystal may be readily inserted into or removed from the crystal seat area of the watch case 82 disposed adjacent to the adapter 85. It is necessary that the movement be removed from the watch, leaving only the case and flexible crystal to be positioned. The female adapter 87 can be placed in the fixed jaw (on left) and the "bullet" adapter in the movable jaw, so that the female adapter seats on the watch case or outside of the crystal. The bullet adapter is placed inside the case and presses on the center of the crystal, reducing its size for removal. Cemented hard crystals can be removed by placing the female adapter on the outside of the case, then using a smaller female adapter to press remove the glass crystal. The adapters 85 and 87 may also be utilized together to remove a crystal from a case. It is further pointed out that the adapters 85 and 87 may be provided in different sizes and/or shapes. Additional functions of this embodiment of accessory include, for example, pressing the back of a watch case onto the case, removing and/or replacing crystals, or securely holding watch cases having multiple function crowns or other projections.

A flanged sleeve 152 with arbor pin 156, as shown in FIG. 9, can be used in the vise, optionally in conjunction with the male adapter 85, for a second operation to remove watchband pins and/or links. Metal watch band/brackets, for example, have sizing links 164 with press pins 162 joining each link. The two shank portions of this flanged sleeve 152 and of adapter 85 are received into bores 50 and 48 of jaws 22 and 14, respectively. More specifically, the flanged sleeve 152 with a shank 154 is received in bore 50 of movable jaw 22. The sleeve has a male flange 158. A steel arbor pin 156 is inserted through central hole 159 in sleeve 152 with base 155 of arbor pin 156 providing a light press fit therein. Both shank 154 and sleeve 152 and the butt end of arbor pin 156 will seat against the end of the hole in movable jaw 22. A fixed male adapter 85 is received in bore 48 of jaw 14, the center aperture 160 of which receives, in use, the arbor pin 156 and/or the pressed link pin 162 from a watchband link. Recess 98 in the nose of the adapter 85 helps to guide the arbor pin 156 into the hole 160. With these accessories in the vise, watchband pins and links can easily be removed or replaced.

Figure 10:
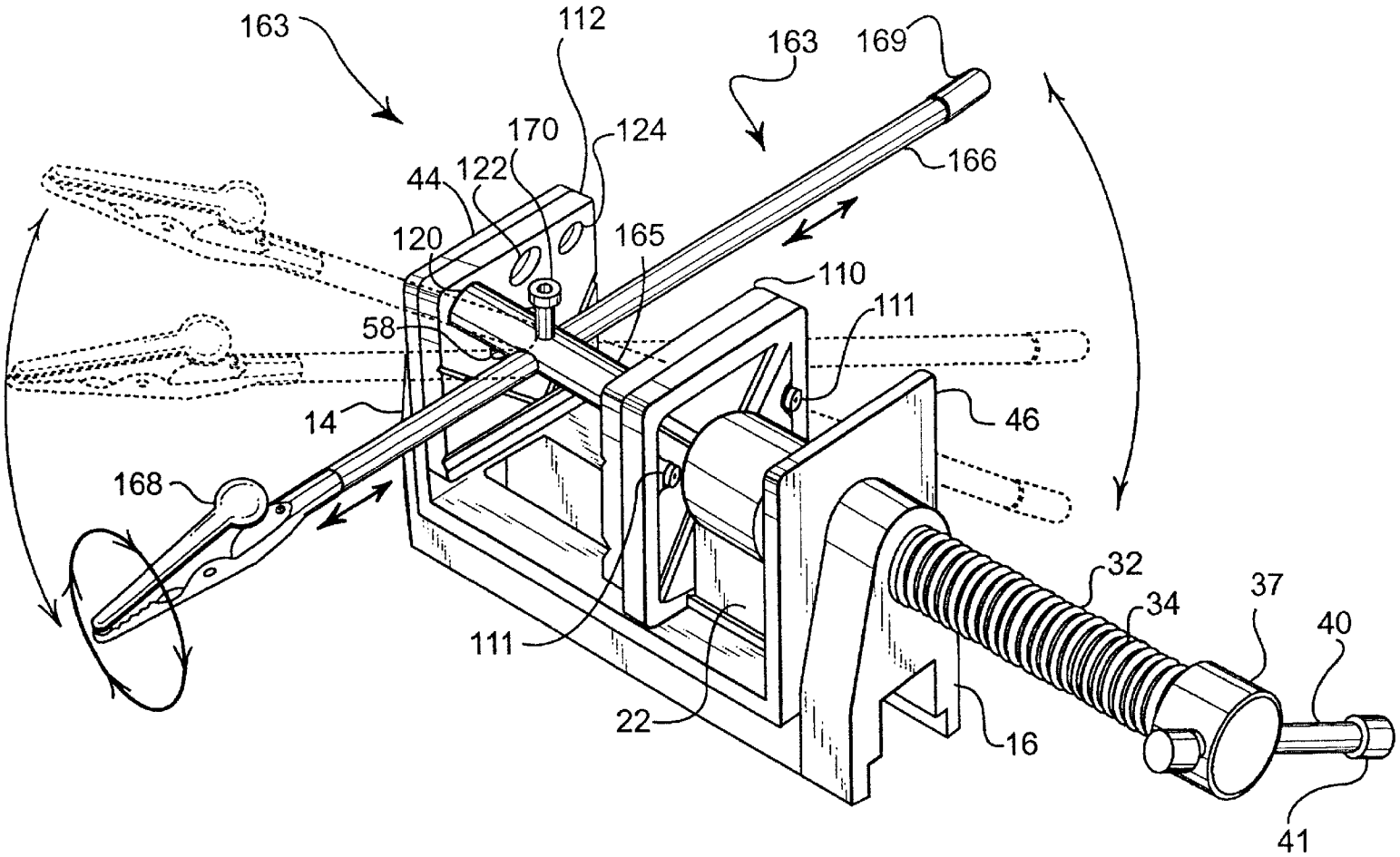
FIG. 10 is a perspective view of an adjustable arm and clip jaw accessory in the vise.

Another embodiment of an accessory, a multidirectional holding fixture 163, includes an arm 166 with a clip jaw accessory 168, as shown in FIG. 10, wherein a cylindrical shaft 165 is received in bores 48 and 50 of jaws 14 and 22, or alternatively, the corresponding coaxial circular openings, e.g. 114 and 120, of vise jaw panel members 110 and 112 (as shown here), such that when the vise portion of the system is tightened, a "third hand" accessory for holding is provided. Accessory 163 includes a locking position shaft 165 with a rod 166 having a holding member 168, e.g., a spring clip or clamp, mounted thereon, (attached by press fit or other suitable mechanical means) running laterally therethrough. Shaft 164 has securing means such as a lock screw 170 for locking and adjustment purposes. The rod 166 may thus be vertically and laterally rotated and/or longitudinally adjusted and locked into place with relation to shaft 165. Via the rotational placement of the shaft 165, the held article may be positioned most suitably to create a work area specific to the article or workpiece upon which work is being performed. A nonskid bushing 169 or the like can be attached to the end of rod 166 to facilitate this. The rotational and sliding adjustments provide three degrees of freedom.

Figure 11:
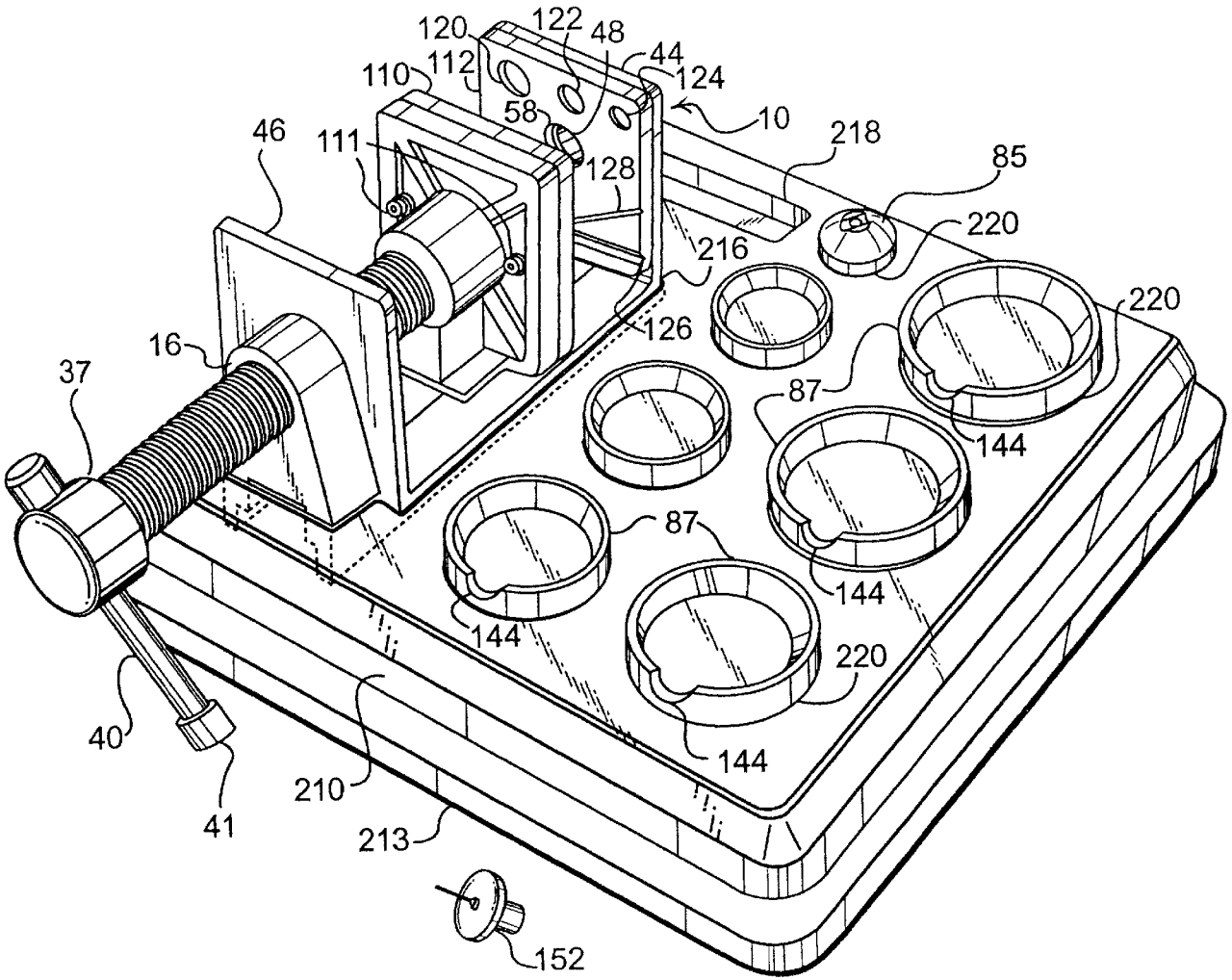
FIG. 11 is a perspective view of the vise and base portions of the vise system.

As is shown, a number of accessory embodiments for securing various types of workpieces may be adapted for use with the instant vise system. As is further shown in FIG. 11, there are two distinct portions of the instant vise system; the portable vise portion 10 and the optional base portion 210, into which the vise portion inserts and contiguously rests snugly in recess 216. The base portion 210 has a layer of skid-resistant material 213, described supra, mounted on the bottom surface thereof, thereby providing skid-resistance and stability for the vise system on most flat, regular surfaces. Tile base may further serve to organize and/or carry various jaw accessories such as adapters 85 and 87 by using recesses 220 to removably but snugly hold these items. Other recesses such as 218 can be provided in various shapes and sizes to hold small items such as flanged sleeve 152 and wedge tool 132. An additional recess (not shown here) can be provided in base 210 to hold a different portion of vise 10, e.g. fixed jaw 14, to provide different orientation(s) for use or storage:

The foregoing is considered as illustrative only on the principles of the invention. Further, since numerous modifications and changes will readily occur to those skilled in the art, it is not desired to limit the invention to the exact construction and operation shown and described, and accordingly, all suitable modifications and equivalents may be resorted to, falling with the scope of the invention.

While the above description contains much specificity, these specificities should not be construed as limitations on the scope of the invention, but rather exemplification of the preferred embodiments thereof. That is to say, the foregoing description of the invention is exemplary for purposes of illustration and explanation. Without departing from the spirit and scope of this invention, one skilled in the art can make various changes and modifications to the invention to adapt it to various usages and conditions. As such, these changes and modification are properly and equitably intended to be within the full range of equivalence of the following claims. Thus, the scope of the invention should be determined only by the appended claims and their legal equivalents, rather than by the embodiments described herein.

I claim:

1. A portable vise for securely holding a workpiece and in particular a watch case and delicate jewelry without damage thereto, the vise comprising:

a vise base;

a first jaw having a first planar face, said first jaw attached to said vise base;

a second jaw having a second planar face, said second planar face parallel to said first planar face; said second jaw movably attached on said vise base for moving said second planar face toward and away from said first planar face;

a first shape-conforming, deformable, relatively thick jaw panel, said first jaw panel attached to said first planar face, said first jaw panel having a first opening therein, a portion of a front side of the first opening adapted for engaging one side of the workpiece, a back side of the first opening covered by a portion of said first planar face for providing a firm backing when the workpiece is compressed against the front side of the first opening; and a second shape-conforming, deformable, relatively thick jaw panel, said second jaw panel attached to said second planar face, said second jaw panel having a second opening therein, the second opening coaxial with the first opening, a portion of a front side of the second opening adapted for engaging an opposite side of the workpiece, a back side of the second opening covered by a portion of said second planar face for providing a firm backing when the workpicce is compressed against the front side of the second opening.

2. The vise as described in claim 1 wherein the first opening is adapted for engaging one side of the workpiece with at least one point of contact and wherein the second opening is adapted for engaging the opposite side of the workpiece with at least one point of contact.

3. The vise as described in claim 1 wherein the first and second openings are circular and have substantially the same diameter.

4. The vise as described in claim 3 wherein said first jaw panel includes a third circular opening having a different diameter than the first circular opening and said second jaw panel includes a fourth circular opening having a different diameter than the second circular opening, the third circular opening coaxial with the fourth circular opening.

5. The vise as described in claim 1 wherein said first jaw and said first planar face include a horizontal bore therethrough, said first jaw panel having a first accessory opening therethrough, the first accessory opening coaxial with the horizontal bore, the horizontal bore and the first accessory opening receiving a shank of a first article engaging accessory therein.

6. The vise as described in claim 5 wherein said second planar face includes a blind bore therein, said second jaw panel having a second accessory opening therein, the second accessory opening coaxial with the first accessory opening, the blind bore and the second accessory opening receiving a shank of a second article engaging accessory therein.

7. The vise as described in claim 5 wherein the first accessory opening is a first circular accessory opening.

8. The vise as described in claim 6 wherein the second accessory opening is a second rectangular accessory opening.

9. The vise as described in claim 1 wherein said second jaw is attached to one end of a threaded screw, said threaded screw mounted on said vise base, said threaded screw used for moving said second planar face toward and away from said first planar face.

10. A portable vise for securely holding a workpiece and in particular a watch case and delicate jewelry without damage thereto, the vise comprising:

a vise base;

a fast jaw having a first planar face, said first jaw attached to said vise base;

a second jaw having a second planar face, said second planar face parallel to said first planar face, said second jaw movably attached on said vise base for moving said second planar face toward and away from said first planar face;

a first shape-conforming, deformable, relatively thick jaw panel, said first jaw panel having an upper portion, a center portion and a lower portion, said first jaw panel attached to said first planar face;

a first circular opening in the upper portion of said first jaw panel, a portion of a front side of the first opening adapted for engaging one side of the workpiece, a back side of the first opening covered by a portion of said first planar face for providing a firm backing when the workpiece is compressed against the front side of the first opening;

a second shape-conforming, deformable, relatively thick jaw panel, said second jaw panel having an upper portion, a center portion and a lower portion, said second jaw panel attached to said second planar face;

a second circular opening in the upper portion of said second jaw panel, the second opening coaxial with the first opening, a portion of a front side of the second opening adapted for engaging an opposite side of the workpiece, a back side of the second opening covered by a portion of said second planar face for providing a firm backing when the workpiece is compressed against the front side of the second opening;

a third circular opening in the upper portion of said first jaw panel, the third opening having a different diameter than the first opening, a portion of a front side of the third opening adapted for engaging one side of the workpiece, a back side of the third opening covered by a portion of said first planar face for providing a firm backing when the workpiece is compressed against the front side of the third opening; and a fourth circular opening in the upper portion of said second jaw panel, the fourth opening having a different diameter than the second opening, the fourth opening coaxial with the third opening, a portion of a front side of the fourth opening adapted for engaging an opposite side of the workpiece, a back side of the third opening covered by a portion of said second planar face for providing a firm backing when the workpiece is compressed against the front side of the fourth opening.

11. The vise as described in claim 10 wherein the first opening and the third opening are adapted for engaging one side of the workpiece with at least one point of contact and wherein the second opening and the fourth opening are adapted for engaging the opposite side of the workpiece with at least one point of contact.

12. The vise as described in claim 10 wherein said first jaw and said first planar face include a horizontal bore therethrough, said first jaw panel having a first accessory opening in the center portion and therethrough, the first accessory opening coaxial with the horizontal bore, the horizontal bore and the firs accessory opening receiving a shank of a first article engaging accessory therein.

13. The vise as described in claim 12 wherein said second planar face includes a blind bore therein, said second jaw panel having a second accessory opening in the center portion and therein, the second accessory opening coaxial with the first accessory opening, the blind bore and the second accessory opening receiving a shank of a second article.

14. The vise as described in claim 12 wherein the first accessory opening is a first circular accessory opening.

15. The vise as described in claim 13 wherein the second accessory opening is a second rectangular accessory opening.

16. A portable vise for securely holding a workpiece and in particular a watch case and delicate jewelry without damage thereto, the vise comprising:

a vise base;

a fast jaw having a first planar face, said first jaw attached to said vise base;

a second jaw having a second planar face, said second planar face parallel to said first planar face said second jaw movably attached on said vise base for moving said second planar face toward and away from said first planar face;

a first shape-conforming, deformable, relatively thick jaw panel, said first jaw panel attached to said first planar face, said first jaw panel having a first opening therein, a portion of a front side of the first opening adapted for engaging one side of the workpiece, a back side of the first opening covered by a portion of said first planar face for providing a firm backing when the workpiece is compressed against the front side of the first opening;

a second shape-conforming, deformable, relatively thick jaw panel, said second jaw panel attached to said second planar face, said second jaw panel having a second opening therein, the second opening coaxial with the first opening, a portion of a front side of the second opening adapted for engaging an opposite side of the workpiece, a back side of the second opening covered by a portion of said second planar face for providing a firm backing when the workpiece is compressed against the front side of the second opening;

a horizontal bore through said first jaw and said first planar face; and a first accessory opening through said first jaw panel, the first accessory opening coaxial with the horizontal bore, the horizontal bore and the first accessory opening receiving a shank of a first article engaging accessory therein.

17. The vise as described in claim 16 wherein the first opening is adapted for engaging one side of the workpiece with at least one point of contact and wherein the second opening is adapted for engaging the opposite side of the workpiece with at least one point of contact.

18. The vise as described in claim 16 wherein the first and second openings are circular and have substantially the same diameter.

19. The vise as described in claim 16 wherein said first jaw panel includes a third circular opening having a different diameter than the first circular opening and said second jaw panel includes a fourth circular opening having a different diameter then the second circular opening, the third circular opening coaxial with the fourth circular opening.

20. The vise as described in claim 16 wherein said second planar face includes a blind bore therein, said second jaw panel having a second accessory opening therethrough, the second accessory opening coaxial with the first accessory opening, the blind bore and the second accessory opening receiving a shank of a second article engaging accessory therein.

21. The vise as described in claim 16 wherein the first accessory opening is a first circular accessory opening.

22. The vise as described in claim 20 wherein the second accessory opening is a second rectangular deformable article engaging panel opening.

23. The vise as described in claim 16 wherein said first article engaging accessory is a wedge tool accessory, said wedge tool accessory having a wedge-shaped end at one end and a shank at an opposite end, the shank removable and rotatable in the horizontal bore and the first accessory opening and adapted for engaging the workpiece disposed at different angles when held between said first and second jaw panels.

24. The vise as described in claim 16 wherein said first and said second jaw panels include a horizontal groove and an oblique groove therein.

25. The vise as described in claim 16 further include a vise base holder having a opening in a top thereof for receiving a bottom of said vise base, a bottom of said vise base holder having a skid-resistant material attached thereto.

* * * * *